United States Patent [19]

Inghram

[11] Patent Number: 4,796,750

[45] Date of Patent: Jan. 10, 1989

[54] SEPARATE KEYHOLDER APPARATUS AND SAME COMBINED WITH WALLET

[76] Inventor: Dan Inghram, Paddock Pl. at Vermont Ave., Toms River, N.J. 08753

[21] Appl. No.: 79,923

[22] Filed: Jul. 31, 1987

[51] Int. Cl.[4] ..... A45C 11/32

[52] U.S. Cl. ..... 206/37.4; 70/456 R; 150/131; 150/147; 206/38.1

[58] Field of Search ..... 70/456 R; 206/37.1, 206/37.3, 37.4, 37.6, 37.7, 38.1; 150/131, 132, 136, 138, 147

[56] References Cited

U.S. PATENT DOCUMENTS

| | | | |
|---|---|---|---|
| 1,719,120 | 7/1929 | Miles | 150/131 X |
| 1,772,891 | 8/1930 | Gardner | 150/132 |
| 1,782,003 | 11/1930 | Epstein | 150/132 |
| 1,877,910 | 9/1932 | L'Enfant | 206/37.4 X |
| 1,877,912 | 9/1932 | L'Enfant | 206/37.4 |
| 2,187,375 | 1/1940 | Florin | 150/138 X |
| 2,219,561 | 10/1940 | Miller | 206/37.1 |
| 2,358,008 | 9/1944 | Herbener | 150/136 |
| 2,635,665 | 4/1953 | Ashley | 206/37.4 |
| 2,704,101 | 3/1955 | Wittrien | 206/37.4 |
| 2,835,300 | 5/1958 | Silha | 150/132 |
| 3,926,234 | 12/1975 | Dean | 206/37 |
| 4,286,641 | 9/1981 | Watson | 206/37.4 |
| 4,306,433 | 12/1981 | Kelly | 70/456 R |
| 4,331,194 | 5/1982 | Lederer | 206/37.4 |

FOREIGN PATENT DOCUMENTS

| | | | |
|---|---|---|---|
| 1266751 | 6/1961 | France | 206/37.1 |

*Primary Examiner*—Lloyd A. Gall

*Attorney, Agent, or Firm*—Richard C. Litman

[57] ABSTRACT

Combined keyholders and wallets include a plurality of overlying layers forming a currency pocket therebetween and to which is attached at least one key cover having a plurality of cut-outs along opposite edges. A plurality of adjacent key receiving pockets are formed beneath the key cover by alternate axial and angular lines of attachment between the key cover and one of the layers. Multiple key covers may be provided as well as combinations of key covers, card-bearing sections and hidden compartments.

5 Claims, 2 Drawing Sheets

SEPARATE KEYHOLDER APPARATUS AND SAME COMBINED WITH WALLET

BACKGROUND OF THE INVENTION

1. FIELD OF THE INVENTION

The invention relates to a key container or keyholder which may be combined with a wallet and more specifically, the invention is directed to an improved device for carrying and protecting keys in conjunction with credit and business cards, photos, identification, keys and the like.

The invention further relates to an improved device to securely retain keys and which provides for a more compact or slender storage with added protection from loss as compared with keychains, keytainers and other prior key retention devices. More particularly, the invention is directed to providing for combined storage of a multiple number of keys plus storage and protection of credit cards, photos, and identification cards.

The invention can be used in a variety of situations including storage in back pockets, coat pockets and purses, either as a separate key storage unit or as indicated in combination with men and women billfolds and wallets. When used separately, the invention provides an apparatus that allows keys to lay flat as possible in a man's pants or jacket pocket. This is a substantial improvement over existing practices wherein keys would make a lump or bulge in one's pocket.

The utility and unique advantages of this invention stem from the method of construction and the arrangement of the elements of this invention and is more fully described herein.

2. DESCRIPTION OF PRIOR ART

Various prior art combination keyholders and wallets are well known and found to be exemplary of the U.S. prior art. They are:

| U.S. Pat. No.: | Inventor: |
|---|---|
| 1,719,120 | Miles |
| 1,877,910 | L'Enfant |
| 1,877,911 | L'Enfant |
| 1,877,912 | L'Enfant |
| 2,219,561 | Miller |
| 2,635,665 | Ashley |
| 2,703,596 | Kromer |
| 2,704,101 | Wittrien |
| 3,926,234 | Dean |
| 4,286,641 | Watson |
| 4,331,194 | Lederer |
| 4,417,612 | Couture |

U.S. Pat. No. 1,719,120 to Miles discloses a wallet for keys, but does not disclose an outside edge or enfoldment to prevent keys from slipping out.

U.S. Pat. Nos. 1,877,910, 1,877,911, and 1,877,912 to L'Enfant disclose combined cardcase and keyholders.

However neither of these devices discloses a means for systematically retaining different shaped and sized keys neatly and uniformly in the holding sections of said devices. Each discloses a flap or fold to protect the keys from loss, thus making removal of the keys very difficult. The present invention does not require a flap or fold.

U.S. Pat. No. 2,219,561 to Miller discloses a key case in which keys may be secured and specifically discloses a flap of V-shape for the securement of the key, biasing one or two keys toward a kerf or enclosure within the material of the billfold.

U.S. Pat. Nos. 2,635,665 to Ashley and 4,417,612 to Couture, et al, disclose pocket keyholders. The Ashley patent secures keys via a series of zig-zag stitching which does not fully utilize the space within the device nor does it secure keys from loss by utilizing an outside rib as does the present invention. In the case of Couture, et al., two outer sheets of material fully encompass the extent of a plurality of keys thus precluding ready identification thereof while disparate material, in the form of Velcro strips are used to close the access to the contained keys.

U.S. Pat. No. 2,703,596 to Kromer discloses a device with two flaps to keep keys in place. In a similar manner U.S. Pat. No. 3,926,234 to Dean discloses a device with panels and flaps and individualized compartments in which keys are stored, these compartments having no means of biasing keys against the material thereby to secure them for greater safety.

U.S. Pat. No. 4,286,641 to Watson discloses a combination business card and key storage device utilizing transparent sheets with slits for the insertion of keys and subsequently requiring the user to fully open the device for the removal of keys.

U.S. Pat. No. 4,331,194 to Lederer shows a key holding device utilizing two pockets formed by folds of material over a baseboard. Keys thus stored are not individually contained and are thereby subject to falling out of the folds.

Likewise, the Kromer U.S. Pat. No. 2,703,596 and U.S. Pat. No. 2,704,101 to Wittrien do not provide the same method of securing keys as does the present invention. These inventions relate to methods of securing keys based on the use of flaps, enclosures or compartments.

These patents or known prior uses teach and disclose various types of combined wallets and keyholders. None of them, however, taken singly or in combination, disclose the combination of the present invention in such a way as to bear upon the claims of this invention.

SUMMARY OF THE INVENTION

An object, advantage and feature of the invention is to provide a greatly improved combined keyholder and wallet that is safe in use and efficient to manufacture. It allows the safe keeping of keys along with the carrying of money, credit cards, photos, identification, and the like.

It is a further object of the present invention to provide an improved keyholder offering a much flatter, more convenient manner of carrying keys as compared to bulky keychains or the like and which is extremely practical to produce.

DESCRIPTION OF THE PREFERRED EMBODIMENTS

Figure 1:
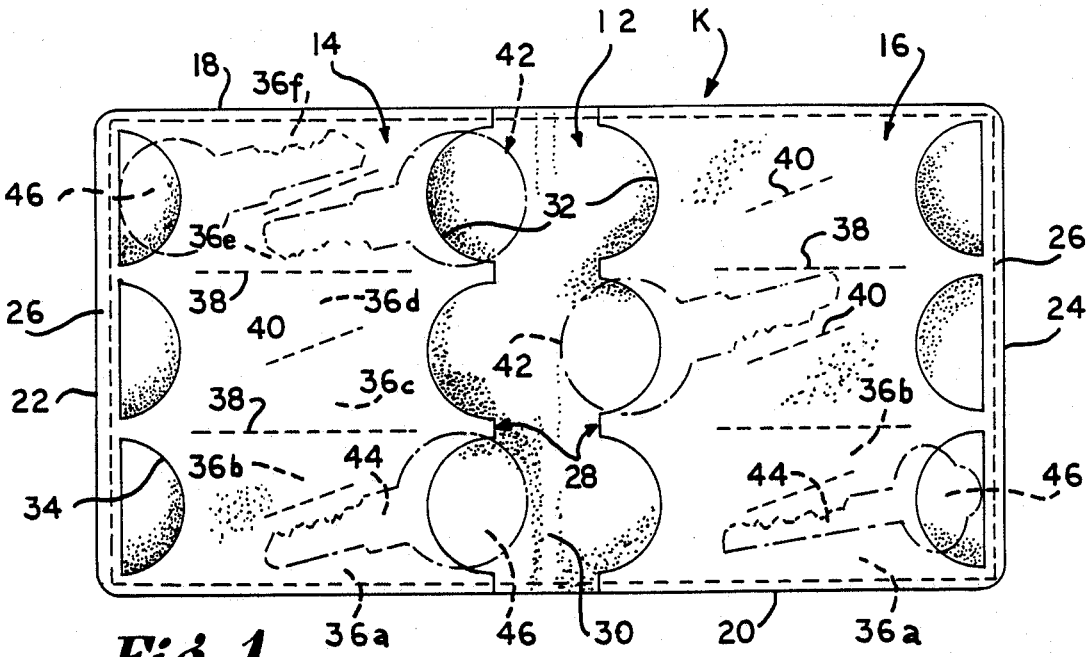
FIG. 1 is a top plan view of one keyholder device according to the present invention and illustrates a combination comprising dual keyholders and a wallet.

Referring now to the drawings, there is shown in FIG. 1 a top plan view of a combined wallet and keyholder K made of any suitable foldable or pliable material such as leather, vinyl or the like. The device comprises a plurality of sheets of material including a first or outer rectangular layer 10 coextensive with and juxtaposed a second or inner rectangular layer 12. Overlying these layers are two laterally adjacent substantially rectangular sheets comprising key covers 14, 16 each overlying slightly less than one-half the extent of the first and second layers 10, 12. The above layers of material are affixed together along the longitudinal parallel edges or sides 18, 20 and end edges or sides 22, 24 such that all layers are fastened together in a sandwiched manner along the three edges 20, 22, 24 while the inner layer 12 is attached only to the two key covers 14, 16 to provide an opening 25 along the edge 18 whereupon access may be had to the resultant currency pocket formed between the layers 10, 12.

The key covers 14, 16 are both constructed in a specific manner and attached to the inner layer 12 in a unique way so as to provide a maximum key capacity with improved security and slimness. Each cover 14 or 16 is constructed of a single thickness layer of integral material and includes a coplanar outer edge band 26 adjacent the end edge 22 or 24. The center edge 28 of each cover is spaced outwardly from the ridge or center, fold line 30 of the device K and will be seen to be scalloped to provide a plurality of adjacent, yet slightly spaced apart semi-circular secant and curved cut-outs 32. Spaced slightly inwardly of the outer edge band 26 are an equal number of similarly configured secant and curved cut-outs 34, the latter of which are longitudinally aligned with the secant and curved cut-outs 32 at the opposite end of the cover. All of these cut-outs 34 serve the dual purpose of providing access to and from pockets or compartments formed beneath the covers as well as allow visual identification of keys associated therewith.

A plurality of separate key pockets **36*a*–36*f* are formed beneath each key cover 14, 16 by the attachment together of specific areas of the opposed surfaces of the covers 14, 16 and inner layer 12. The pockets are defined by means of a plurality of longitudinal or axial lines 38 and adjacent, angularly offset lines 40. These lines are most conveniently provided by stitching through the covers and the underlying inner layer 12. As will be seen from the view of FIG. 1, the axial lines 38 are relatively long and parallel to the device longitudinal edges 18, 20 but fall short and are located laterally and symmetrically intermediate the pairs of opposed cut-outs 32, 34 and their respective edges or sides while the shorter angular lines 40 falling short of axial lines 38** are substantially diagonal or inclined 45 degrees and are disposed through a centerline bisecting each pair of opposed cut-outs.

With the above described arrangement it will be seen that each angular line 40 cooperates with one adjacent axial line on either side to form two angularly directed key pockets such as **36*a*, 36*b*. With this construction, a key 42 may be inserted into a selected pocket, following the angle as reflected by the line 40, so that the shank 44 of the key is fully disposed within the angular pocket while the key head 46 is partially beneath the cover but mostly exposed within the cut-out 32 or 34. Those keys 42 inserted through the cut-outs 34 adjacent the device end edges 22, 24 will be understood to have their heads 46 located inwardly of the cover outer edge bands 26 such that in all instances the keys are flushly disposed against the surface of the inner layer 12** to provide a minimum bulk to the utilized device.

In addition to the snug fit provided by the angular offset of the center lines 40, the keys are precluded from accidentally sliding out from their respective pockets by abutment with either the co-planar outer edge bands 26 or the fold or ridge line 30 exhibited as the device is folded and carried by the user.

It will be appreciated that the device K may be constructed with but one of the key covers 14 or 16 if so desired. As such, both ends may be provided with an outer edge band 26. Likewise, the inclusion of the outer layer 10 is optional since such a key container may be combined with any suitable existing wallet to provide the combination including a currency pocket.

Figure 4:
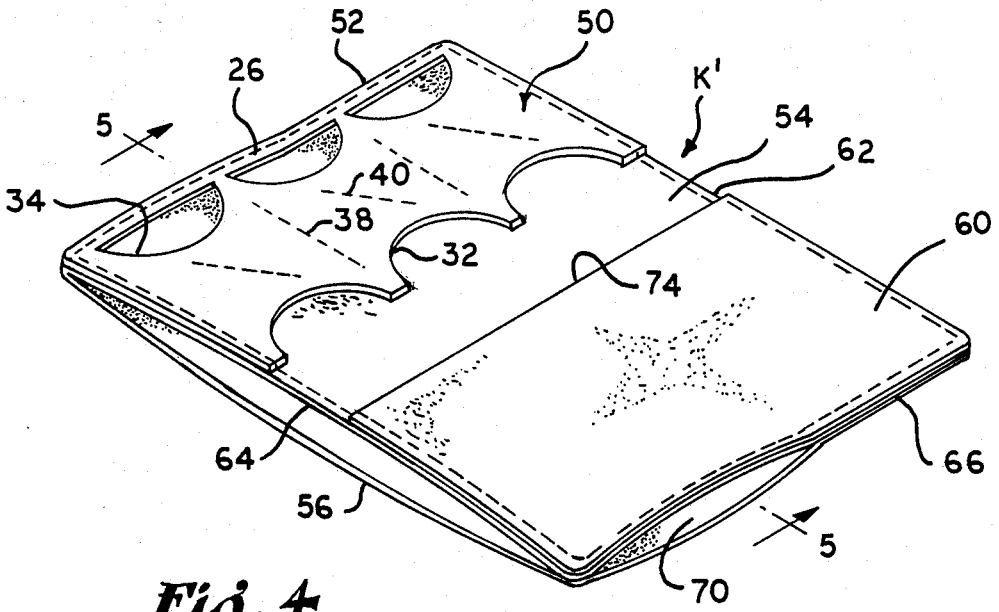
FIG. 4 is a perspective view illustrating an alternate embodiment.
Figure 5:
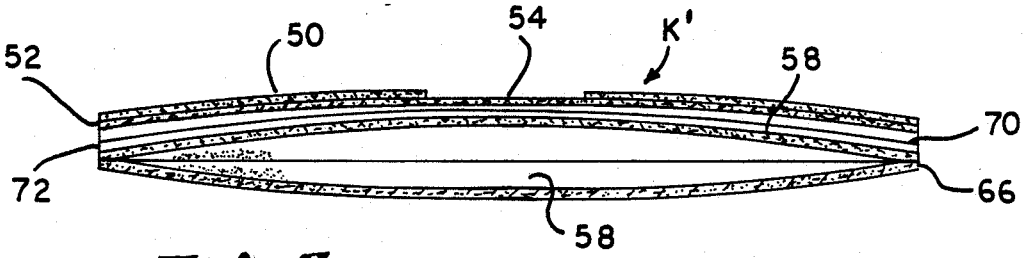
FIG. 5 is a cross-sectional view taken along the line 5—5 of FIG. 4.

Still another variation is shown in FIGS. 4 and 5 of the drawings wherein a wallet and key holder K′ is generally similar to the device K but only includes a single key cover 50 adjacent one end edge 52 and which overlies a full size inner layer 54. A full size outer layer 56 is also included and is combined with an intermediate full size layer 58. The opposite half of the inner layer 54 is covered with a half size top layer 60. The above components are assembled by stitching, or otherwise fastening the end edge of the key cover 50 to the underlying inner layer 54 while the longitudinal edges 62, 64 of both the key cover and top layer 60 are similarly fastened to the inner layer. The full length of the end edge of the top layer 60 is likewise affixed to the inner layer 54. The stitching along the edge 62 will be understood to extend through all of the various stacked layers while from a review of FIGS. 4 and 5 it will be noted that the stitching along the remaining edges follows another pattern with respect to the intermediate and outer layers 56, 58. At the end edges 52 and 66 the intermediate and outer layers are stitched along their entire lengths such that a currency pocket 68 is formed therebetween with access through the opening along edge 64. The edge 64 of the intermediate and inner layers 58, 54 are fixed together while only part of the end edges 52, 64 of these two layers are stitched so as to provide respective end pockets 70, 72. The remaining open edge 74 of the top layer 60 provides access to still another pocket formed between this layer and the underlying inner layer 54.

Figure 3:
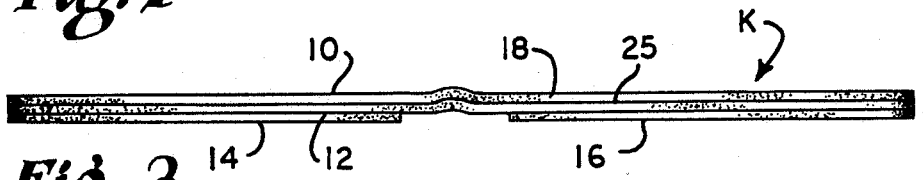
FIG. 3 is a bottom elevation view of the device shown in FIG. 1.
Figure 2:
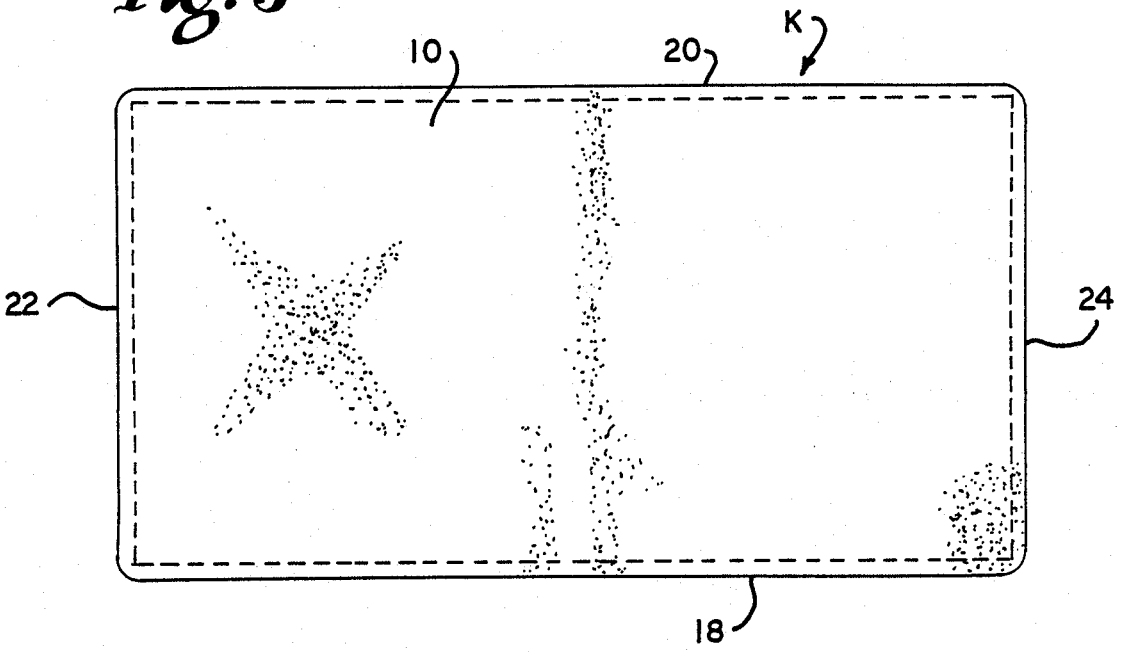
FIG. 2 is a bottom plan view of the combined wallet and keyholder of FIG. 1.
Figure 6:
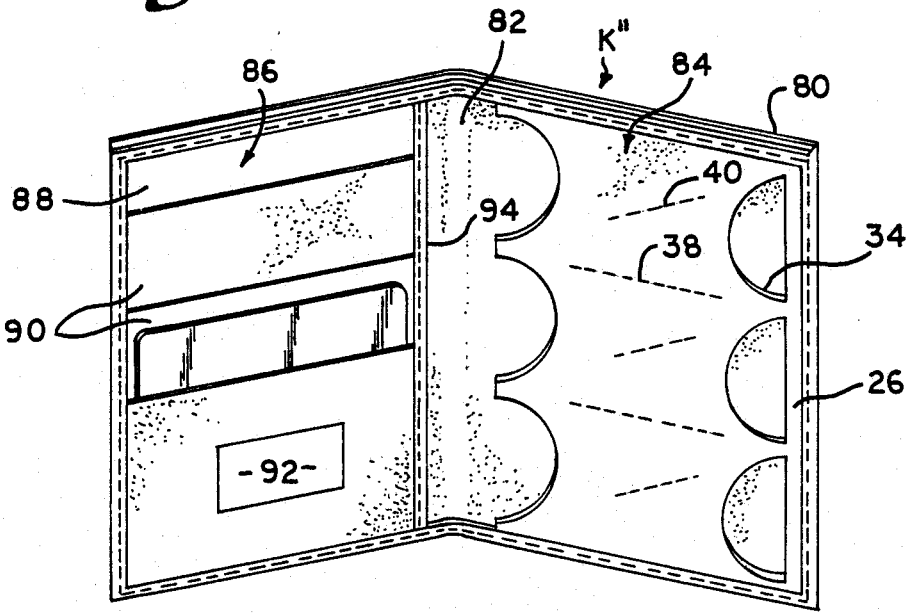
FIG. 6 is a perspective view of still another embodiment.

The embodiment of FIG. 6 comprises a combined wallet, card holder and key holder K″ having an outer layer 80 and inner layer arranged and stitched as in the case of the device K of FIGS. 1–3. Included is a single half size key cover constructed and attached as in the case of the key covers shown in FIGS. 1 and 4 and which is combined with a card-bearing section 86 on the other half. This section includes a base layer 88 over which are disposed a plurality of vertically staggered partitions 90 each forming a card receiving pocket as shown. The lowest partition includes a window 92 behind which may be stored the users identification. The inner free edge 94 of the base layer 88 provides access to a pocket for the storage of other cards or similarly flat items.

The foregoing is considered as illustrative only to the principles of the invention. Various ones of the above-described components may be assembled in numerous combinations to fully utilize the concept of the present invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. A compartmentalized receptacle comprising:

first rectangular means, having four sides, for forming first walls of compartments for keys;

second rectangular means, having four sides, for forming second walls of said compartments for said keys;

said first rectangular means and said second rectangular means being leathery;

three sides comprising two parallel sides and an end side on said second rectangular means, stitched to three sides of said first rectangular means;

a fourth side on said second rectangular means opposite and parallel to said end side;

said compartments delineated by parallel stitching including stitching between said two parallel sides and by diagonal stitching centered between said parallel stitching;

curvedly shaped cuts with secants formed in said second rectangular means symmetrically arranged to said parallel stitching;

said secants delineated by cuts adjacent and parallel to said stitching of said end side and along said fourth side;

fold means bisecting said first rectangular means with said second rectangular means on at least one side of said fold means;

abutment means for limiting travel of said keys out of said compartments comprising said secants delineated by cuts and said fold means.

2. The compartmentalized receptacle of claim 1 wherein:

said first rectangular means comprises two layers stitched together on three sides to form a currency pocket.

3. The compartmentalized receptacle of claim 1 wherein:

said diagonal stitching falls short of said parallel stitching; and said parallel stitching falls short of said middle side and said fourth side.

4. The compartmentalized receptacle of claim 1 further comprising:

a top layer overlying said first rectangular means and spaced from and adjacent said second rectangular means;

stitching affixing said top layer to said first rectangular means;

an open edge on said top layer opposed to said second rectangular means; and access is provided to a pocket intermediate said first rectangular means and said top layer.

5. A compartmentalized receptacle of claim 1 comprising;

a card bearing section affixed to said first rectangular means adjacent and spaced from said second rectangular means;

said section including a base layer having a plurality of vertically staggered partitions attached thereto;

said base layer affixed to first rectangular means; and said base layer including an inner free edge opposed to said second rectangular means, whereby access is provided to a pocket intermediate said base layer and said first rectangular means.

* * * * *